US009635447B2

(12) United States Patent
Yuen

(10) Patent No.: US 9,635,447 B2
(45) Date of Patent: Apr. 25, 2017

(54) EARPIECE CASING CAVITY AND CORRESPONDING EARPHONE

(75) Inventor: Shunming Yuen, Hong Kong (CN)

(73) Assignee: INNOVATION SOUND TECHNOLOGY CO., LTD., Guangdong (CN)

( * ) Notice: Subject to any disclaimer, the term of this patent is extended or adjusted under 35 U.S.C. 154(b) by 69 days.

(21) Appl. No.: 14/415,314

(22) PCT Filed: Jul. 17, 2012

(86) PCT No.: PCT/CN2012/078755
§ 371 (c)(1),
(2), (4) Date: May 26, 2015

(87) PCT Pub. No.: WO2014/012217
PCT Pub. Date: Jan. 23, 2014

(65) Prior Publication Data

US 2015/0296284 A1 Oct. 15, 2015

(51) Int. Cl.
*H04R 1/02* (2006.01)
*H04R 1/10* (2006.01)

(52) U.S. Cl.
CPC ..... *H04R 1/10* (2013.01); *H04R 1/1016* (2013.01); *H04R 2460/11* (2013.01)

(58) Field of Classification Search
CPC ... H04R 1/1008; H04R 1/2853; H04R 1/2857
See application file for complete search history.

(56) References Cited

U.S. PATENT DOCUMENTS 8,447,058 B1 * 5/2013 Sung ..... H04R 1/2826 381/370
8,588,453 B1 * 11/2013 Lee ..... H04R 1/1008 381/370

(Continued)

FOREIGN PATENT DOCUMENTS

CN 201426163 U 3/2010
CN 201904901 U 7/2011

(Continued)

*Primary Examiner* — Curtis Kuntz
*Assistant Examiner* — Ryan Robinson
(74) *Attorney, Agent, or Firm* — Fitch, Even, Tabin & Flannery LLP

(57) ABSTRACT

The utility model discloses an ear cup cavity and a corresponding earphone, the ear cup cavity comprising: a speaker face shell (1), a speaker cavity (2), a speaker (3) and a rear shell (4); the speaker cavity (2) is an annular labyrinth type structure which is fixed on the speaker face shell (1); the speaker face shell (1) is provided with the first air port (11) through which air passes and enters into the speaker cavity (2); the second air port (21) through which air enters into the speaker cavity (2) is arranged on the position of the speaker cavity (2) corresponding to the first air port (11); the rear shell (4) is a bowl-shaped structure for accommodating the speaker cavity (2) and the speaker (3). The ear cup cavity and corresponding earphone provided in the embodiments of the utility model can timely release superfluous air gathered in the front cavity of the earphone, control the air release process well and avoid the generation of new noise so as to ensure clear sound played from the earphone and improve the user experience.

9 Claims, 4 Drawing Sheets

(56) References Cited

U.S. PATENT DOCUMENTS

| | | | | |
|---|---|---|---|---|
| 9,247,337 | B2 * | 1/2016 | Foudhaili | H04R 1/1083 |
| 2007/0092098 | A1 | 4/2007 | Kaderavek | |
| 2008/0101640 | A1 * | 5/2008 | Ballad | G10K 11/025<br>381/338 |
| 2009/0161885 | A1 | 6/2009 | Donaldson et al. | |
| 2013/0308786 | A1 * | 11/2013 | Sibbald | H04R 1/1083<br>381/71.6 |

FOREIGN PATENT DOCUMENTS

| | | | |
|---|---|---|---|
| CN | 202103822 | U | 1/2012 |
| CN | 202282851 | U | 6/2012 |
| CN | 202841481 | U | 3/2013 |

* cited by examiner

EARPIECE CASING CAVITY AND CORRESPONDING EARPHONE

FIELD OF THE INVENTION

The utility model relates to the audio playing equipment field, in particular to an ear cup cavity and corresponding earphone.

BACKGROUND OF THE INVENTION

As an audio output device, the earphone is widely used, such as walkman, CD player, MP3 player etc. The user can enjoy the fun of the music alone and does not affect the others during using the earphone.

The ear cup cavity (i.e. audio cavity) of the earphone plays an important role in the sound performance of the earphone. The existing earphone generally uses the design of double audio cavities as shown in FIG. 1 to express the shock strength of bass, especially super bass in high quality. In the existing earphone, a front cavity 91 consists of a front cover 80, a speaker face shell 81 and a speaker 82, a rear cavity 92 consists of a rear cover 83, a speaker face shell 81 and a speaker 82; the portion between the speaker 82 and the rear cavity 92 is an air port 90, one function of the air port 90 is venting. Currently, FIG. 1 is only the simplest situation, in actual use, different earphone may use different design, but the same principle is adopted, the speaker face shell and the speaker separate the front, rear cavities of the earphone in general.

However, during the implementation process of the utility model, the inventor founds that in actual use of the existing earphone with the design of double audio cavities, more air is gathered in the front cavity of the earphone due to outwards continuously played sound from the speaker, when the air gathered in the front cavity of the earphone is superfluous, the sound quality of the sound played from the earphone is directly affected, mainly resulting in vague and unclear sound.

Contents of Utility Model

The technical issue to be solved by the embodiments of the utility model is providing an ear cup cavity and the corresponding earphone, which can timely release superfluous air gathered in the front cavity of the earphone, control the air release process well and avoid the generation of new noise so as to ensure clear sound played from the earphone and improve the user experience.

To solve the technical issue, the utility model provides an ear cup cavity, comprising a speaker face shell 1, a speaker cavity 2, a speaker 3 and a rear shell 4;

The speaker cavity 2 is an annular labyrinth type structure which is fixed on the speaker face shell 1;

The speaker face shell 1 is provided with the first air port 11 through which air passes and enters into the speaker cavity 2; the second air port 21 through which air enters into the speaker cavity 2 is arranged on the position of the speaker cavity 2 corresponding to the first air port 11;

The rear shell 4 is a bowl-shaped structure for accommodating the speaker cavity 2 and the speaker 3.

Wherein, the rear shell 4 is provided with the third air port 41 through which air passes and is discharged from the ear cup cavity.

Wherein, the speaker 3 is arranged in a barrel-shaped space surrounded by the speaker face shell 1 and the speaker cavity 2.

Wherein, the centre of the speaker face shell 1 is provided with the first through hole 12 through which the sound from the speaker 3 is transferred outwards, the first through hole 12 is consistent with the sounding face of the speaker 3 in shape.

Wherein, the speaker cavity 2 comprises a substrate 22 and a cavity 23;

the centre of the substrate 22 is uniformly provided with the second through hole 23 through which the sound from the speaker 3 is transferred outwards, the area of the second through hole 23 on the substrate 22 corresponds to the area of the first through hole 12;

the outer edge of the substrate 22 is provided with an annular labyrinth type cavity 23; a barrel-shaped space for accommodating the speaker 3 is surrounded by the area of the second through hole 23 at the centre of the substrate 22 and the side wall of the labyrinth type cavity 23.

Wherein, the centre of the speaker face shell 1 is uniformly provided with the first through hole 12 through which the sound from the speaker 3 is transferred outwards, the area of the first through hole 1 on the speaker face shell 1 is consistent with the sounding face of the speaker 3 in shape.

Wherein, the area surrounded by the speaker cavity 2 is consistent with the area of the first through hole 12 on the speaker face shell 1, and a barrel-shaped space for accommodating the speaker 3 is surrounded by the side wall of the speaker cavity 2 and the area of the first through hole 12 on the speaker face shell 1.

Correspondingly, the embodiments of the utility model further provides an earphone, the earphone includes the ear cup cavity as claimed above.

Wherein, the air which enters into the first air port 11 and the second air port 21 is the air gathered in the front cavity of the earphone.

The ear cup cavity and corresponding earphone provided in the embodiments of the utility model can timely release superfluous air gathered in the front cavity of the earphone, control the air release process well and avoid the generation of new noise so as to ensure clear sound played from the earphone and improve the user experience.

BRIEF INTRODUCTION OF THE DRAWINGS

To describe the technical solution in the embodiments of the utility model or in the prior art, the necessary drawings in the embodiments or the prior art are briefly introduced, obviously, the drawings described below are only some embodiments of the utility model, the skilled in the art can obtain the other drawings based on the drawing without paying the creative work.

DETAILED DESCRIPTION OF THE PREFERRED EMBODIMENTS

The ear cup cavity and corresponding earphone provided in the embodiments of the utility model can timely release superfluous air gathered in the front cavity of the earphone, control the air release process well and avoid the generation of new noise so as to ensure clear sound played from the earphone and improve the user experience.

In combination with the drawings in the embodiments of the utility model, the technical solution in the embodiments of the utility model can be described clearly and completely as follows, obviously, the described embodiments are only one part of embodiments of the utility model but not all of the embodiments. All other embodiments obtained by the skilled of the art based on the embodiments of the utility model without paying the creative work are to be embraced within the scope of protection of the utility model.

Figure 1:
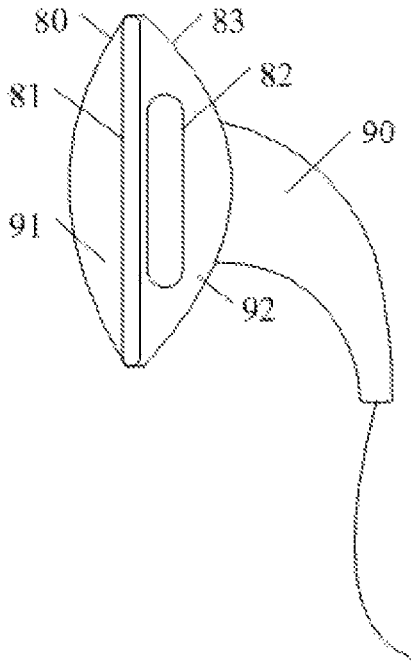
FIG. 1 is the structural schematic view of the existing earphone.
Figure 2:
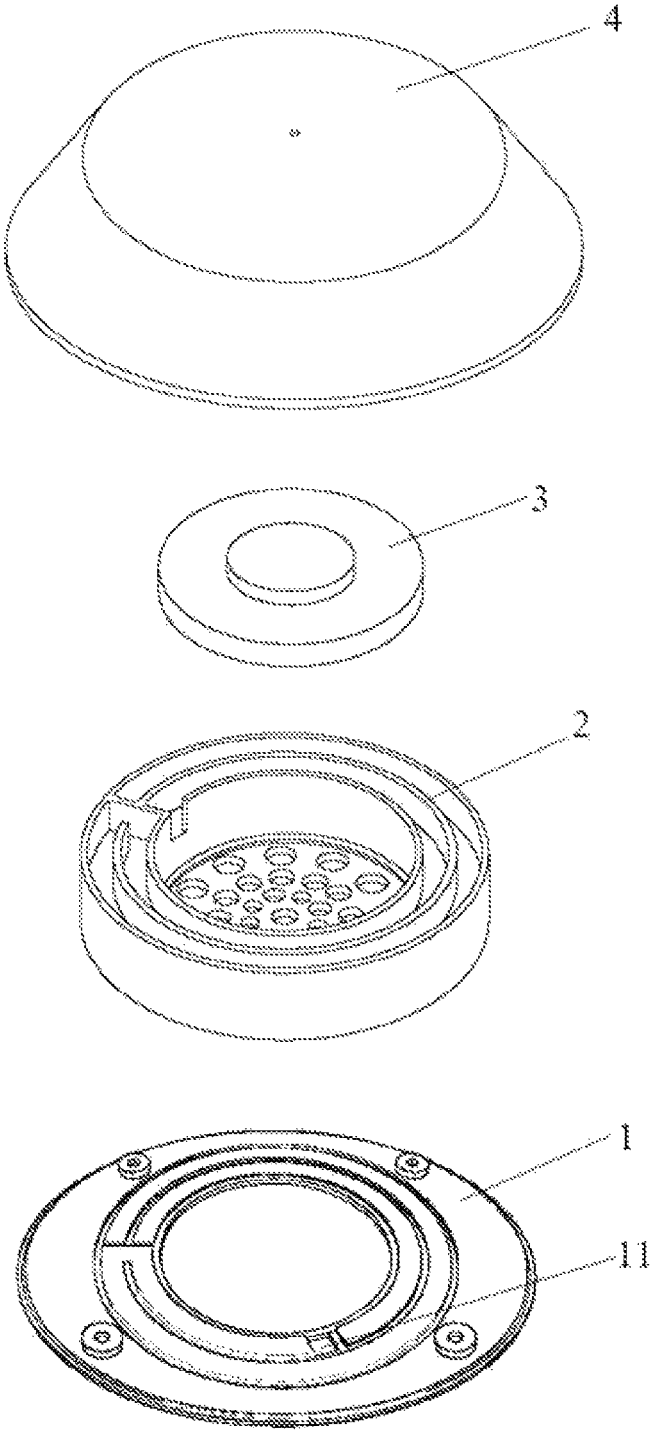
FIG. 2 is the structural schematic view of the first embodiment of the ear cup cavity provided in the utility model.

FIG. 2 is the structural schematic view of the first embodiment of the ear cup cavity provided in the utility model; as shown in FIG. 2, the ear cup cavity includes: a speaker face shell 1, a speaker cavity 2, a speaker 3 and a rear shell 4.

The speaker cavity 2 is an annular labyrinth type structure which is fixed on the speaker face shell 1.

The speaker face shell 1 is provided with the first air port 11 through which air passes and enters into the speaker cavity 2; the second air port 21 through which air enters into the speaker cavity 2 is arranged on the position of the speaker cavity 2 corresponding to the first air port 11.

The rear shell 4 is a bowl-shaped structure for accommodating the speaker cavity 2 and the speaker 3.

The working principle is: when superfluous air is gathered in the front cavity of the earphone, the superfluous air enters into the speaker cavity 2 through the first air port 11 and the second air port 21 under pressure and is finally discharged from the inside of the earphone so as to release the superfluous air gathered in the front cavity and prevent the air from affecting the sound quality of the earphone. In the utility model, the speaker cavity is designed as a labyrinth type, which simplifies the control of the air discharge process, avoids the generation of the noise and affects the playing effect of the earphone.

Figure 3:
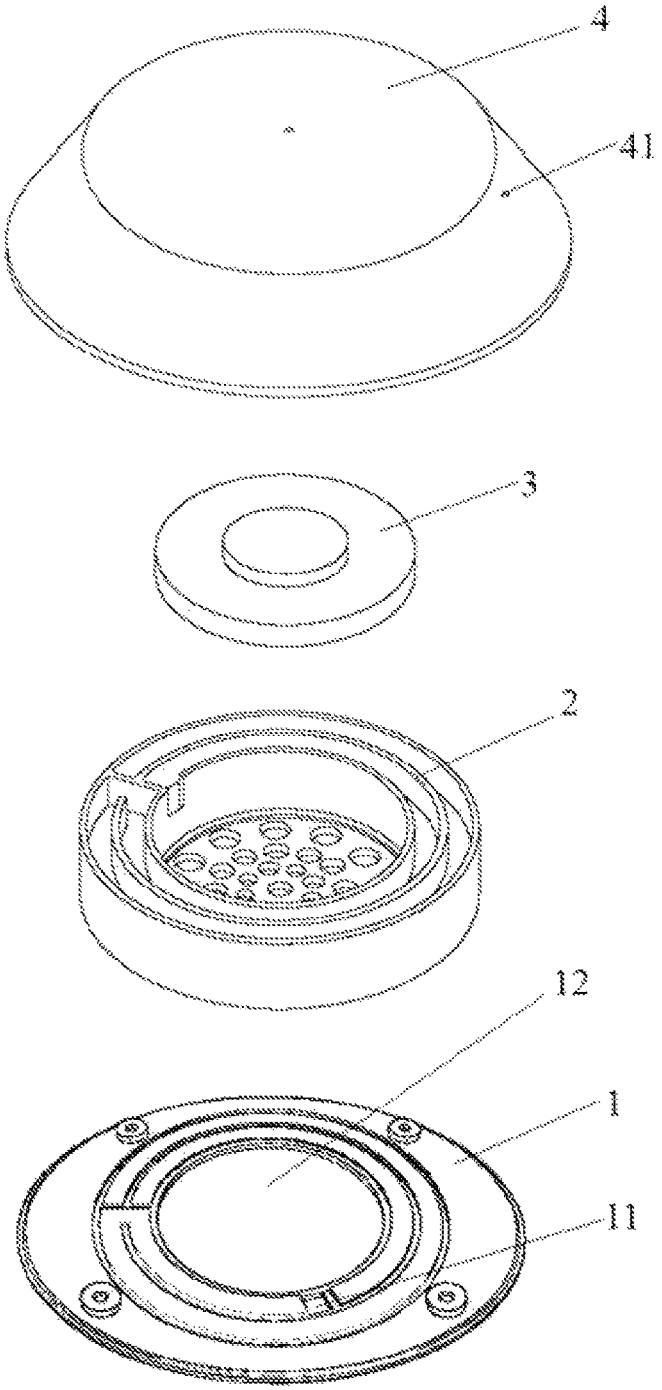
FIG. 3 is the structural schematic view of the second embodiment of the ear cup cavity provided in the utility model.

FIG. 3, is the structural schematic view of the second embodiment of the ear cup cavity provided in the utility model; in the utility model, the specific structure of the ear cup cavity and the function of all parts are described in more detail. As shown in the figures below, the ear cup cavity comprises a speaker face shell 1, a speaker cavity 2, a speaker 3 and a rear shell 4. The speaker cavity 2 can be fixed on the speaker face shell 1, the speaker 3 is accommodated in the barrel-shaped space surrounded by the speaker face shell 1 and the speaker cavity 2, the rear shell 4 is a bowl-shaped structure in which the speaker cavity 2 and the speaker 3, and the edge of the rear shell 1 is interlocked with the speaker face shell 1.

More specifically, the speaker face shell 1 is provided with the first air port 11 through which air passes and enters into the speaker cavity 2. Correspondingly, the second air port 21 through which air passing through the first air port 11 enters into the speaker cavity 2 is arranged on the position of the speaker cavity 2 corresponding to the first air port 11. And the rear shell 4 is provided with the third air port 41 through which the air passing through the speaker cavity 2 is discharged from ear cup cavity.

The working principle is: when the speaker 3 is in a working state, the air will be gathered in the front cavity of the earphone continuously; the air will affect the sound quality of the earphone and makes the sound from the earphone vague and unclear after being gathered enough. After the earphone uses the ear cup cavity provided in the utility model, when there is superfluous air gathered in the front cavity of the earphone, the superfluous air enters into the speaker cavity 2 through the first air port 11 and the second air port 21 under pressure and is finally discharged through the third air port 41 on the rear shell so as to release the superfluous gathered in the front cavity of the earphone and further reduce useless noise and avoid the influence thereof on the sound quality of the earphone.

In addition, the key point of the utility model is designing the annular labyrinth type structure of the speaker cavity 2, and the speaker cavity 2 can be variously structured, the utility model uses two of them as example.

Figure 4:
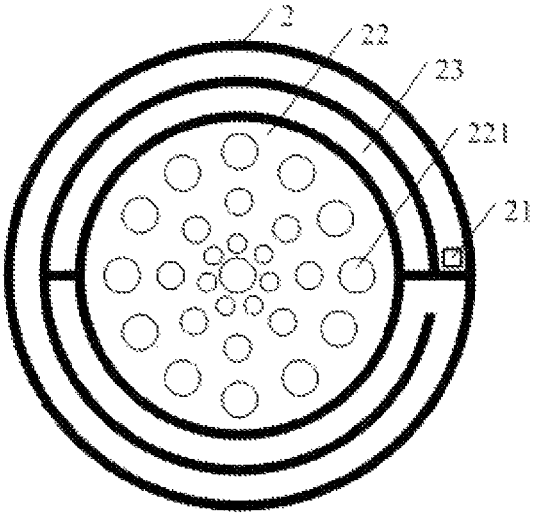
FIG. 4 is the structural schematic view of the speaker cavity of the ear cup cavity provided in the utility model.

The first structure is shown in FIG. 4.

The centre of the speaker face shell 1 is provided with the first through hole 12 through which the sound from the speaker 3 is transferred outwards, the first through hole 12 is consistent with the sounding face of the speaker 3 in shape. The first air port 11 is arranged on the position of the speaker face shell 1 corresponding to the labyrinth type audio cavity, and the size of the first air port 11 can adjust the air flow entering into the speaker cavity 2 so as to achieve a certain degree of sound quality requirement.

The speaker cavity 2 comprises a substrate 22 and a cavity 23.

The centre of the substrate 22 is uniformly provided with the second through holes 221 through which the sound from the speaker 3 is transferred outwards, the area of the second through holes 221 on the substrate 22 corresponds to the area of the first through hole 12 on the speaker face shell 1; the outer edge of the substrate 22 is provided with an annular labyrinth type cavity 23; a barrel-shaped space for accommodating the speaker 3 is surrounded by the area of the second through hole 221 at the centre of the substrate 22 and the side wall of the labyrinth type cavity 23.

The second one is: the centre of the speaker face shell is uniformly provided with multiple first through holes through which the sound from the speaker is transferred outwards, the area of the first through hole on the speaker face shell is consistent with the sounding face of the speaker in shape, the first air port 11 is arranged on the position of the speaker face shell corresponding to the labyrinth type audio cavity, the size of the first air port can adjust the air flow entering into the speaker cavity so as to achieve a certain sound quality requirement.

The area surrounded by the speaker cavity is consistent with the area of the first through hole on the speaker face shell, and a barrel-shaped space for accommodating the speaker is surrounded by the side wall of the speaker cavity and the area of the first through hole on the speaker face shell.

The ear cup cavity provided in the utility model can provide different sound effects transferred to the ears through the front cavity of the earphone. The different specific sound effect is mainly produced by controlling different air flow to enter into the labyrinth type speaker cavity 2 through the first air port 11 of the speaker face shell 1 and to release through the third air port 41 on the rear shell 4.

Different size of the speaker cavity or labyrinth may influence the air flow entering into the speaker cavity through the speaker face shell and finally released through the third air port 41 on the rear shell. Once the size of the speaker cavity or labyrinth was determined, when the earphone working, air flow enters into the labyrinth type speaker cavity through the first air port on the speaker face shell so as to increase the air flow pressure in the speaker cavity, the increased air flow pressure is mainly produced by the external air flowing in the labyrinth type speaker cavity, then the higher air flow is formed in the speaker cavity and released through the third air port 41 on the rear shell. The continuous process may gradually reduce the air flow volume in the front cavity of the earphone. Moreover, when the labyrinth type speaker cavity is longer, the impact is produced in the labyrinth type cavity to assist the air discharge, in contrast, if the cavity will impede the flow of the air in the cavity when being designed to be small.

In conclusion, the ear cup cavity provided in the utility model designs the speaker cavity to be a labyrinth type so as to timely release superfluous air gathered in the front cavity of the earphone, control the air release process well and avoid the generation of new noise so as to ensure clear sound played from the earphone and improve the user experience.

To be sure, the ear cup cavity provided in all embodiments of the utility model can be applied to various types of earphones.

Notably, the utility model described one product form of the ear cup cavity and corresponding earphone, the other products satisfying the structure of the utility model, even if the elements without influencing the product characteristics, such as material, name of component, appearance and component arrangement order are different, are still to be embraced within the scope of protection of the utility model.

The content mentioned above is the further detailed description of the utility model in combination with the specific preferred embodiments and it should not be considered that the specific embodiments of the utility model are to be limited in these descriptions. To the skilled in the art of the utility model, making multiple simple deductions or replacements without departing from the conception of the utility model should be regarded as being embraced within the scope of protection of the utility model.

The invention claimed is:

1. An ear cup cavity comprising:

a speaker face shell;

a speaker;

a speaker cavity comprising a substrate and an annular labyrinth type cavity structure which is fixed on the speaker face shell, a centre of the substrate being uniformly provided with at least one second through hole through which the sound from the speaker is transferred outwards, an outer edge of the substrate being provided with the annular labyrinth type cavity structure; and a barrel-shaped space for accommodating the speaker being surrounded by the area of the at least one second through hole at the centre of the substrate and a side wall of the labyrinth type cavity structure;

a rear shell having a bowl-shaped structure for accommodating the speaker cavity and the speaker;

a first air port in the speaker face shell through which air passes and enters into the speaker cavity;

a second air port through which air enters into the speaker cavity arranged on the position of the speaker cavity corresponding to the first air port; and a first through hole provided in a centre of the speaker face shell through which sound from the speaker is transferred outwards, the first through hold being consistent with a sounding face of the speaker in shape, wherein the area of the at least one second through hole on the substrate corresponds to the area of the first through hole.

2. The ear cup cavity as claimed in claim 1, wherein the rear shell is provided with the third air port through which air passes and is discharged from the ear cup cavity.

3. An earphone, wherein the earphone includes the ear cup cavity as claimed in claim 1.

4. The earphone as claimed in claim 3, wherein the air which enters into the first air port and the second air port is the air gathered in the front cavity of the earphone.

5. An ear cup cavity, comprising:

a speaker face shell;

a speaker cavity comprising an annular labyrinth type structure fixed on the speaker face shell;

a speaker;

a rear shell having a bowl-shaped structure for accommodating the speaker cavity and the speaker;

a first air port in the speaker face shell through which air passes and enters into the speaker cavity;

a second air port through which air enters into the speaker cavity arranged on the position of the speaker cavity corresponding to the first air port;

a first through hole provided in a centre of the speaker face shell through which sound from the speaker is transferred outwards, the first through hole being consistent with a sounding face of the speaker in shape, wherein the area surrounded by the speaker cavity is consistent with the area of the first through hole on the speaker face shell, and a barrel-shaped space for accommodating the speaker is surrounded by the side wall of the speaker cavity and the area of the first through hole on the speaker face shell.

6. The ear cup cavity as claimed in claim 5, wherein the speaker is arranged in a barrel-shaped space surrounded by the speaker face shell and the speaker cavity.

7. An earphone, wherein the earphone includes the ear cup cavity as claimed in claim 5.

8. The earphone as claimed in claim 7, wherein the air which enters into the first air port and the second air port is the air gathered in the front cavity of the earphone.

9. The ear cup cavity as claimed in claim 5, wherein the rear shell is provided with the third air port through which air passes and is discharged from the ear cup cavity.

* * * * *